US005778829A

United States Patent [19]

Min

[11] Patent Number: 5,778,829

[45] Date of Patent: *Jul. 14, 1998

[54] GAS BOILER

[75] Inventor: Tae-Sik Min, Seoul, Rep. of Korea

[73] Assignee: Daewoo Electronics Co., Ltd., Seoul, Rep. of Korea

[ * ] Notice: The term of this patent shall not extend beyond the expiration date of Pat. No. 5,596,953.

[21] Appl. No.: 578,184

[22] Filed: Dec. 29, 1995

[30] Foreign Application Priority Data

Mar. 31, 1995 [KR] Rep. of Korea ..... 95-7372

[51] Int. Cl.[6] ..... F22B 5/00

[52] U.S. Cl. ..... 122/17; 122/6 R; 122/367.1

[58] Field of Search ..... 122/367.1, 367.2, 122/367.3, 17, 6 R

[56] References Cited

U.S. PATENT DOCUMENTS 5,596,953 1/1997 Hong ..... 122/17

FOREIGN PATENT DOCUMENTS 0236235 9/1987 European Pat. Off. .
0244915 11/1987 European Pat. Off. .
2126471 6/1972 France .

*Primary Examiner*—Henry A. Bennett
*Assistant Examiner*—Jiping Lu
*Attorney, Agent, or Firm*—Beveridge, DeGrandi, Weilacher & Young LLP

[57] ABSTRACT

Disclosed is a gas boiler which has a simple structure, which is easy to be installed, and which is manufactured at a low cost. The typical water tank is partitioned into an upper casing and a lower casing which are capable of communicated with each other. A three-way valve and a circulation pump are mounted to the lower casing in a row in the horizontal direction, and the plurality of pipelines are arranged by using the above serial arrangement as a reference. A recess for retaining a printed circuit board box is formed in one side of the upper casing. The three-way valve is coupled to the lower casing and circulation pump is to the three-way valve. Therefore, the size of the gas boiler is minimized and the manufacturing cost thereof is economized.

20 Claims, 8 Drawing Sheets

GAS BOILER

BACKGROUND OF THE INVENTION

1. Field of the Invention

The present invention relates to an improved gas boiler, and more particularly to a gas boiler which has a simple internal pipeline structure, is easy to install, and can be manufactured at a low cost.

2. Description of the Prior Art

Gas boilers of a variety of types have been continuously proposed hitherto for producing hot water and room heating. FIG. 10 illustrates the internal structure of a conventional gas boiler 10 which generally includes a water tank 20, a circulation pump 30, a three-way valve 40, a gas-heated heat exchanger 50, and a box accommodating a printed circuit board (hereinafter simply referred to as "PCB box") 70.

Conventional gas boiler 10 additionally includes a water valve 55, a supplementary water valve 57, a fan 60, a gas valve 74, a plurality of pipelines (not shown), and a plurality of electric wires (not shown).

Referring to FIG. 10, gas boiler 10 has a rear plate 12 consisting of steel. Rear plate 12 is joined with a front cover (not shown). Water tank 20 for retaining the heating water is placed on the upper left portion of rear plate 12. A water level sensing unit 80 is installed at the upper portion of water tank 20. Also, a bypass pipe 90 is installed at the upper right portion of water tank 20, which is connected to the upper left portion of heat exchanger 50 arranged to the right of water tank 20.

A heating water tank (not shown) and a combustion chamber 54 are equipped within heat exchanger 50. A gas supply pipe 72 is connected to the lower portion of heat exchanger 50, which supplies a gaseous fuel such as liquefied natural gas (hereinafter referred to as "LNG") or liquefied petroleum gas (hereinafter referred to "LPG") from an external gas source to heat exchanger 50. A gas valve 74 for adjusting the quantity of the LNG or LPG supplied to heat exchanger 50 is positioned in the middle of gas supply pipe 72. Fan 60 underlies heat exchanger 50.

Meanwhile, an overflow pipe 24, a heating water return pipe 26, a first heating water inlet pipe 28 and a supplementary water supply pipe 58 are connected to the bottom portion of water tank 20.

Here, heating water return pipe 26 is a flow path of the heating water returning from a heating place.

First heating water inlet pipe 28 for recirculating the heating water extends from the lower portion of water tank 20 to be connected to circulation pump 30. Circulation pump 30 is driven by an electric motor (not shown) to raise a pressure of the heating water and circulate the heating water. A second heating water inlet pipe 32 is connected to the upper portion of circulation pump 30. Second heating water inlet pipe 32 extends from circulation pump 30 to be connected to the heating water tank of heat exchanger 50. A pump drain pipe 34 is connected to the lower portion of circulation pump 30. A drain cock 35 is installed to the center of pump drain pipe 34.

Supplementary water supply pipe 58 is connected to a water supply pipe 56. A supplementary water valve 57 is furnished to the middle of supplementary water supply pipe 58, which adjusts the quantity of the supplementary water supplied into water tank 20 via supplementary water supply pipe 58. Water supply pipe 56 provides fresh water and extends from the water source outside gas boiler 10 to enter into the heating water tank of heat exchanger 50. Water valve 55 is mounted in the middle of water supply pipe 56, which adjusts the quantity of the fresh water supplied via water supply pipe 56.

In the upper left portion of heat exchanger 50, water supply pipe 56 is connected to a hot water supply pipe 59, which extends from the left upper portion of heat exchanger 50 to the exterior of gas boiler 10, and supplies the hot water indirectly heated to have a raised temperature within heat exchanger 50 to a user.

Three-way valve 40 is disposed to the right of water supply pipe 56. Three-way valve 40 controls the flow of the heating water. An internal circulation pipe 42 and a heating water supply pipe 52 are connected to the upper portion of three-way valve 40. Internal circulation pipe 42 is connected to first heating water inlet pipe 28 which connects water tank 20 and circulation pump 30. Heating water supply pipe 52 extends from the heating water tank of heat exchanger 50 to be connected to three-way valve 40 via the bottom side of fan 60. A heating water discharge pipe 44 for discharging the heating water from heating water supply pipe 52 to the heating place is connected to the lower portion of three-way valve 40. PCB box 70 is situated to the right of gas valve 74. The printed circuit board within PCB box 70 controls the operation of gas boiler 10.

The operation of conventional gas boiler 10 constructed as above will be briefly described in connection with the flow of the fluid.

The heating water which returns into gas boiler 10 after executing the room heating is introduced into water tank 20 via heating water return pipe 26. The heating water introduced into the interior of water tank 20 blends with the fresh water supplemented into water tank 20 via supplementary water supply pipe 58, and is provided to the interior of circulation pump 30 via first heating water inlet pipe 28.

The heating water introduced into circulation pump 30 is pressed by the pumping operation of circulation pump 30 to flow into the heating water tank of heat exchanger 50 via second heating water inlet tube 32. The heating water admitted into the heating water tank is heated by a gas burner (not shown) disposed in combustion chamber 54 of heat exchanger 50. The heating water,whose the temperature is raised by the heating, flows into three-way valve 40 via heating water supply pipe 52 extending from the right upper portion of the heating water tank.

At this time, if the operational mode of gas boiler 10 is the a heating mode, three-way valve 40 opens heating water discharge pipe 44 in accordance with a control signal from the printed circuit board to discharge the heating water. The heating water discharged as above is directed to the heating place via the heating water supply pipeline. The heating water which release the heat returns to water tank 20 via heating water return pipe 26. The heating water admitted in water tank 20 is successively subjected to the above-stated circulation procedure.

In contrast to the above operation, when the operational mode of gas boiler 10 is the hot water mode, three-way valve 40 shuts off heating water discharge pipe 44 in accordance with the control signal from the printed circuit board. Therefore, the heating water having the raised temperature drifts within circulation pump 30 via internal circulation pipe 42. The heating water, which has a raised temperature and is introduced into circulation pump 30 is in turn provided to the heating water tank of heat exchanger 50 via second heating water inlet pipe 32 together with the heating water returning from the heating place by means of the pumping operation of circulation pump 40. The heating water admitted into the heating water tank is heated by the gas burner arranged within combustion chamber 54 as mentioned above. The heating water heated in this manner is introduced into three-way valve 40 via heating water supply pipe 52. Thereafter, the heating water is subjected to the aforestated circulation procedure to drift just within gas boiler 10.

On the other hand, apart from the circulation of the heating water, the fresh water is provided into the heating water tank of heat exchanger 50 via water supply pipe 56. The fresh water flows via water supply pipe 56, which is arranged as a coil within the heating water tank. At this time, the fresh water is changed into hot water of a high temperature by indirectly receiving the heat transmitted from the heating water which has been heated by the gas burner. The hot water prepared as above is guided to the user via hot water supply pipe 59 extending from water supply pipe 56 on the left of heat exchanger 50. Therefore, the hot water is constantly supplied while gas boiler 10 is operating.

However, in conventional gas boiler 10 as described above, there is a long and complicated pipeline for mutually connecting water tank 20, circulation pump 30, three-way valve 40 and heat exchanger 50. This intricate pipeline impedes the free arrangement of the components during the assembling of the gas boiler. Moreover, because a copper pipe is adopted in consideration of corrosion and a hydraulic pressure in the pipeline of the gas boiler, the long pipeline becomes a factor of consuming a much higher manufacturing cost as such. Furthermore, when a breakdown occurs and repaired, the complicated pipeline requires considerable manpower and time for separating and replacing respective pipes.

U.S. Pat. No. 5,248,085, issued to Niels D. Jensen on the date of Sept. 28, 1993 may be given as one example of simplifying the internal construction of the gas boiler. Here, a switch mechanism placed between a first heat exchanger and a second heat exchanger is formed together with a control mechanism, a shaft and a middle wall of a circulation pump housing to form one assembly unit, thereby simplify the internal construction of the gas boiler. However, the Niels D. Jensen's gas boiler constitutes the assembly unit regardless of the position of a water tank, the circulation pump and a three-way valve for contriving the simplification of the internal structure to thus fail in accomplishing an indeed simple structure of the complicated pipeline.

SUMMARY OF THE INVENTION

The present invention is devised to solve the foregoing problems. Accordingly, it is an object of the present invention to provide a gas boiler which has few internal pipelines, ensures a higher space utilization ratio, is easy to install, and reduces the manufacturing cost.

To achieve the above object, the present invention provides a gas boiler comprising:

- a water tank;
- a heat exchanger for heating a first water and a second water;
- a three-way valve mounted to one side of the water tank;
- a circulation pump mounted to one side of the three-way valve in opposition to the mounting position of the water tank and the three-way valve;
- first guide means for supplying the first water to the heat exchanger and supplying the first water heated within the heat exchanger to a user;
- second guide means for circulating the heated second water between the three-way valve and the heat exchanger by an operation of the three-way valve when an operational mode of the gas boiler is a hot water mode, and directing the heated second water to a heating place by the operation of the three-way valve when the operational mode of the gas boiler is a heating mode;
- third guide means for guiding the second water returning from the heating place into the water tank;
- fourth guide means for guiding the second water directed into the water tank into the circulation pump; and
- a printed circuit board box having a printed circuit board therein for controlling the operation of the gas boiler.

The first guide means comprises a water supply pipe for supplying the first water from a first water supply source outside of the gas boiler to the heat exchanger, and a hot water supply pipe for supplying the first water heated within the heat exchanger. The water supply pipe comprises a water valve for controlling the quantity of the first water supplied into the heat exchanger. The second guide means comprises a second communicating pipe, a first heating water supply pipe, a second heating water supply pipe and a heating water discharge pipe, whereby the three-way valve shuts off the heating water discharge pipe to discharge the heated second water into the circulation pump via the second communicating pipe when the operational mode of the gas boiler is the hot water mode, and shuts off the second communicating pipe to discharge the heated second water to the heating place via the heating water discharge pipe when the operational mode of the gas boiler is the heating mode.

The second communicating pipe allows for fluid communication of the three-way valve and the circulation pump, the first heating water supply pipe allows for the fluid communication of the circulation pump and the heat exchanger, and the second heating water supply pipe allows for the fluid communication of the heat exchanger and the three-way valve.

The three-way valve comprises a three-way valve frame formed with a plurality of coupling holes for mating the three-way valve to the water tank and the circulation pump, a heating water supply hole, a ball space, a spherical ball placed within the ball space and a heating water discharge hole connected to the heating water discharge pipe. The ball shuts off the heating water discharge hole to discharge the heated second water into the circulation pump via the second communicating pipe in accordance with a control signal from the printed circuit board when the operational mode of the gas boiler is the hot water mode, and shuts off the second communicating pipe to discharge the heated second water via the heating water discharge hole in accordance with the control signal from the printed circuit board.

The water tank has a rectangularly-shaped section, and comprises an upper casing having a lower portion opened and a lower casing having an upper portion opened. The upper casing comprises a recess for accommodating the printed circuit board box therein. The recess is formed in one side of the upper casing. The upper casing comprises a first flange formed along a lower marginal periphery of the upper casing for coupling the upper casing to the lower casing, and the lower casing comprises a second flange formed along an upper marginal periphery of the lower casing for coupling the upper casing to the lower casing and a third flange horizontally extending from the second flange for coupling the lower casing to the three-way valve, whereby the first flange and the second flange are coupled altogether, and the third flange is coupled to the three-way valve.

The heat exchanger comprises a heating water tank for retaining the second water, a combustion chamber and a gas burner for heating the second water retained within the heating water tank.

The circulation pump comprises a circulation pump frame formed with a plurality of connecting holes for coupling the circulation pump to the three-way valve, a heating water inlet hole, a pump entrance and a pump drain pipe.

The third guide means is a heating water return pipe. The fourth guide means is a first communicating pipe. The first communicating pipe extends from one side of the water tank into the circulation pump by passing through the three-way valve.

As described above, in the gas boiler according to the present invention, the typical water tank is partitioned into the upper casing and lower casing to be arranged. Also, the lower casing, three-way valve and circulation pump are successively arranged in series in the transversal direction. The recess is formed in one side of the upper casing for placing the PCB box, and then, the internal pipeline is furnished within the gas boiler. Therefore, both first heating water inlet tube 28 for connecting water tank 20 and circulation pump 30, and internal circulation pipe 42 for connecting first heating water inlet tube 28 and three-way valve 40, which have been heretofore adopted in the conventional gas boiler, are removed. Furthermore, a wasteful space within the gas boiler can be reduced. In addition, the pipeline for connecting respective components can be relatively shortened to minimize the size of gas boiler and to reduce the cost of manufacturing the gas boiler.

BRIEF DESCRIPTION OF THE DRAWINGS

The above objects and other advantages of the present invention will become more apparent by describing in detail the preferred embodiment thereof with reference to the attached drawings in which.

DETAILED DESCRIPTION OF THE PREFERRED EMBODIMENT

A preferred embodiment of a gas boiler according to the present invention will be described with reference to the accompanying drawings.

Figure 1:
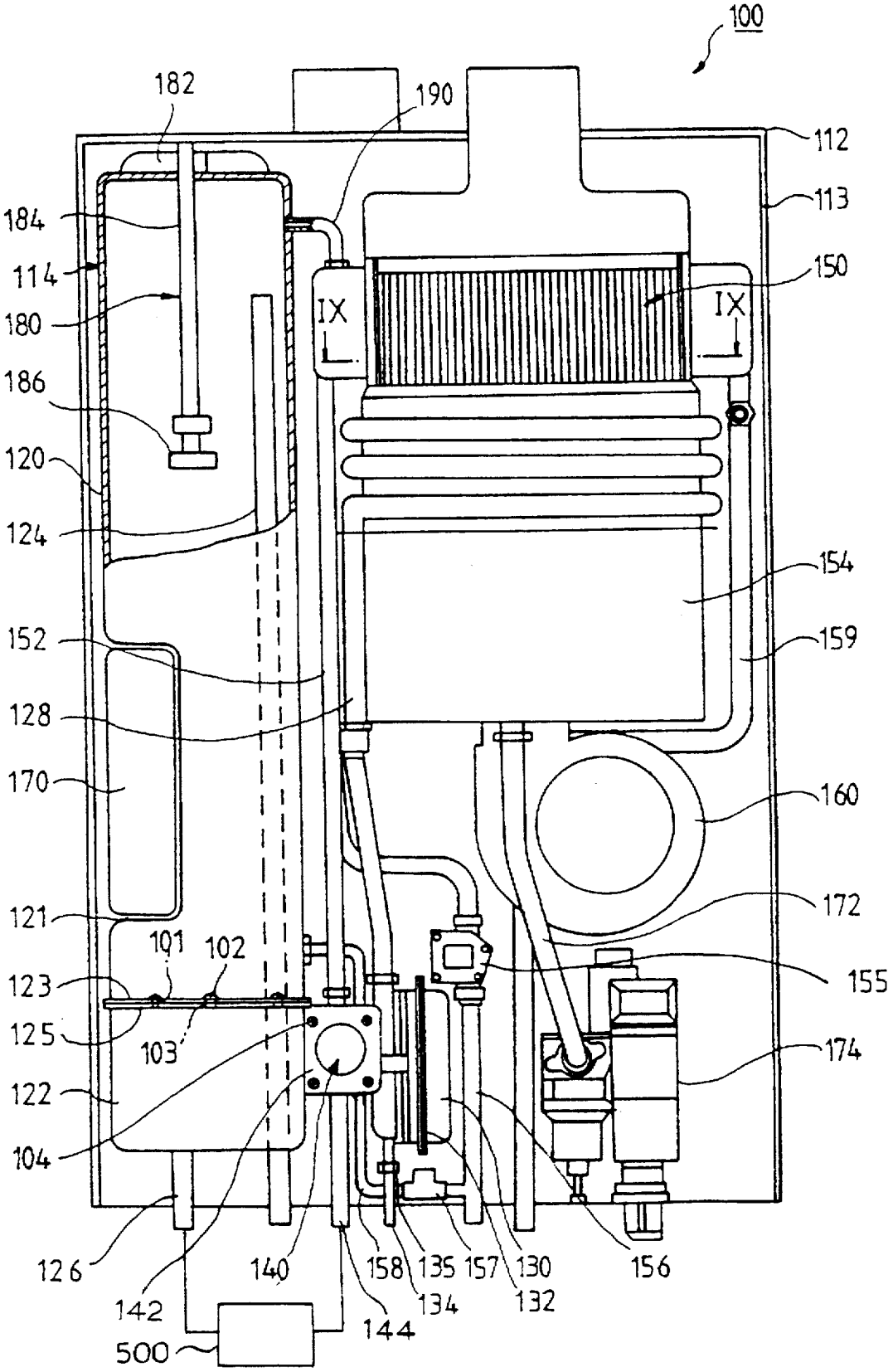
FIG. 1 is a view showing the internal structure of a gas boiler according to the preferred embodiment of the present invention.

Referring to FIG. 1, gas boiler 100 according to the preferred embodiment of the present invention includes a water tank 114, a circulation pump 130, a three-way valve 140 for controlling the flow of heating water, a gas-heated heat exchanger 150 and a PCB box 170 for controlling an operation of gas boiler 100.

Gas boiler 100 also has a water valve 155, a supplementary water valve 157, a feed fan 160, a gas valve 174, a plurality of pipelines (not shown) and a plurality of electric wires (not shown).

In FIG. 1, gas boiler 100 is equipped with a rear plate 112 composed of a sheet of steel plate. Rear plate 112 is joined with a front cover (not shown), and a stage 113 is formed along the marginal periphery thereof for facilitating the joining with the front cover. Water tank 114 for retaining the heating water is disposed to the left of rear plate 112. Water tank 114 sectionally has a rectangular shape, which includes an upper casing 120 and a lower casing 122.

A recess 121 is formed in the left side of upper casing 120. PCB box 170 is placed within recess 121. The lower portion of upper casing 120 is open to be communicated with lower casing 122. A first flange 123 is formed along the lower marginal periphery of upper casing 120 to couple with lower casing 122. A plurality of screw holes 101 are formed in first flange 123.

A water level sensing unit 180 is installed to the upper portion of upper casing 120. Water level sensing unit 180 forces a water level of the heating water retained within water tank 114 to maintain a proper height. Preferably, water level sensing unit 180 is a water gauge. Water level sensing unit 180 includes a fixture 182, a column 184 and a water level sensor 186. Fixture 182 is provided to the ceiling of upper casing 120. Column 184 extends from fixture 182 into the interior of water tank 114. Water level sensor 186 is attached to the end of column 184.

The upper portion of upper casing 120 is equipped with a bypass pipe 190 which is connected to the left upper portion of heat exchanger 150 situated in the right of upper casing 120. Bypass pipe 190 is a flow path for permitting water bubbles generated from the heating water of high temperature to drift within heat exchanger 150.

Figure 9:
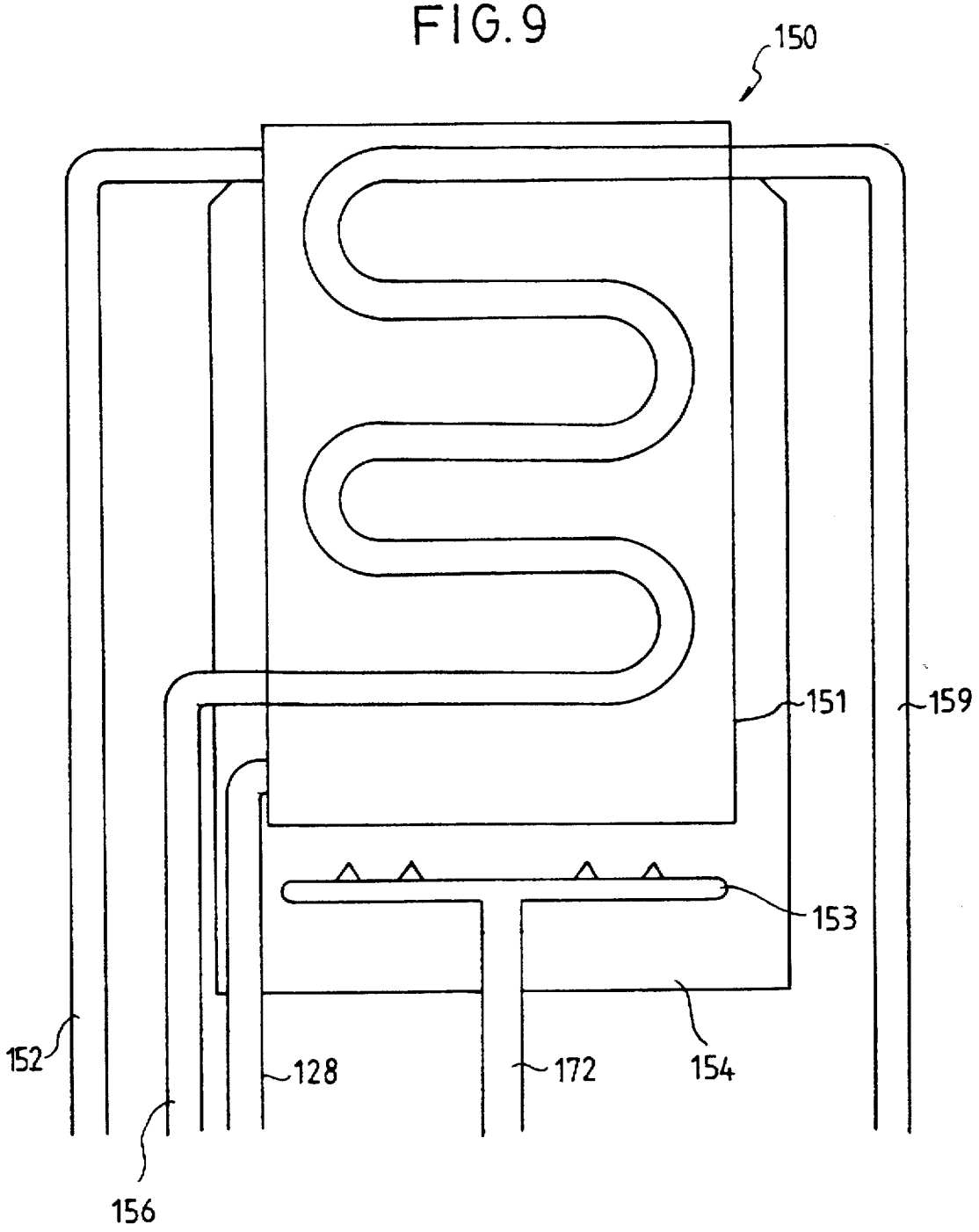
FIG. 9 is a cross section view showing the heat exchanger taken along line IX—IX of FIG. 1.
Figure 10:
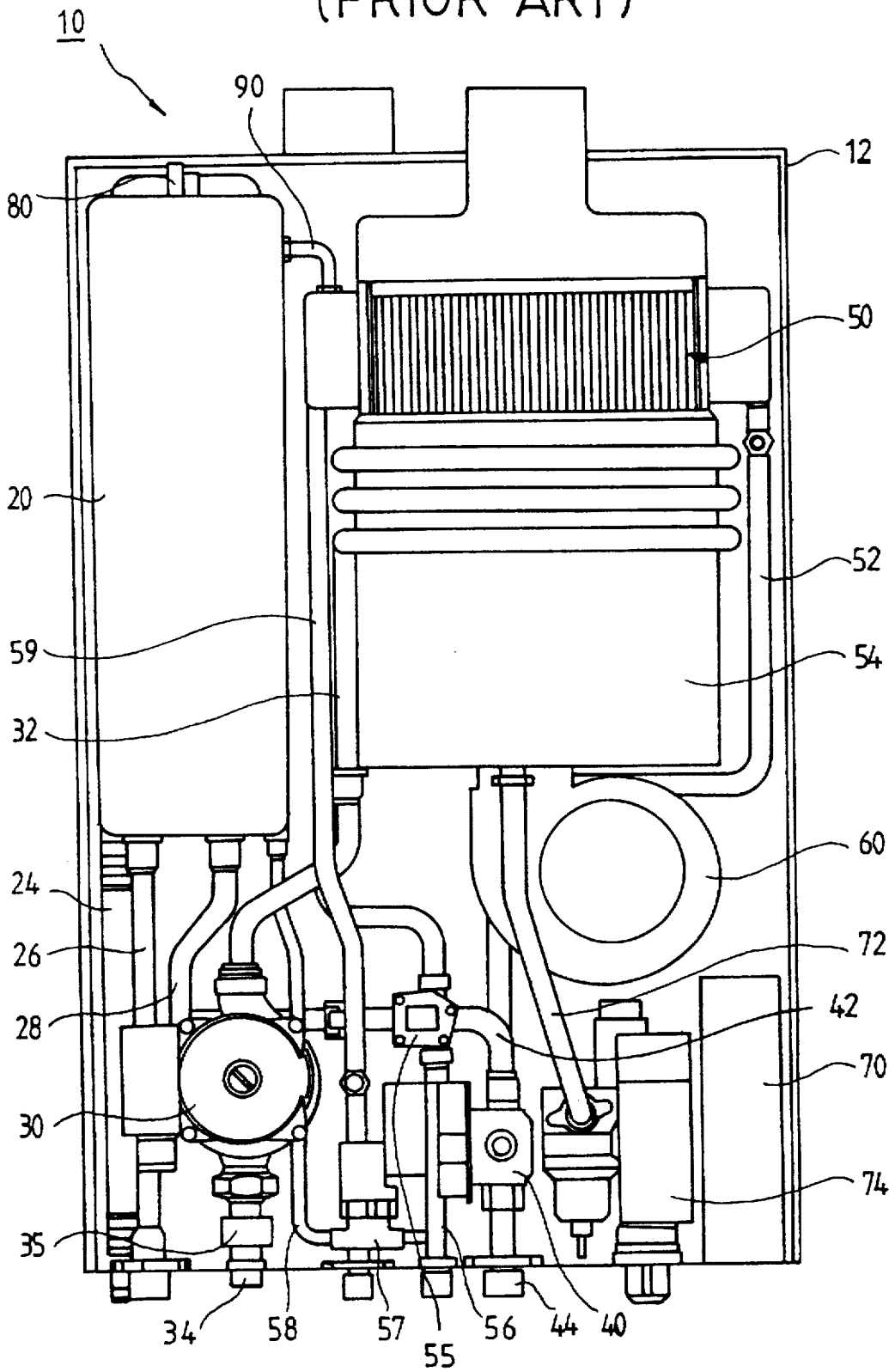
FIG. 10 (PRIOR ART)
FIG. 10 is a view showing the internal structure of a conventional gas boiler.

Heat exchanger 150, as shown in FIG. 9, includes a heating water tank 151 for retaining the heating water supplied from first heating water supply pipe 128, a combustion chamber 154 and a gas burner 153 for heating the heating water housed within heating water tank 151. A water supply pipe 156 introduced from the left lower portion of heat exchanger 150 is arranged within heating water tank 151 as a coil. Gas burner 153 is connected with a gas supply pipe 172. Gas supply pipe 172 provides gaseous fuel such as LNG or LPG from an external gas source (not shown) to gas burner 153.

As illustrated in FIG. 1, gas supply pipe 172 extends from the external gas source of gas boiler 100 to flow into combustion chamber 154. A gas valve 174 is disposed in the middle of gas supply pipe 174. Gas valve 172 adjusts the quantity of the gas supplied to gas burner 153 via gas supply pipe 172. Feed fan 160 is installed below heat exchanger 150. Feed fan 160 provides the air into heat exchanger 150 to serve for assisting the combustion of the gas and preventing a gas explosion within combustion chamber 154.

The upper plane of lower casing 122 is open to be communicated with upper casing 120. A second flange 125 is formed for fitting lower casing 122 to upper casing 120. A plurality of screw holes 103 are formed in second flange 125 to correspond to plurality of screw holes 101 formed in first flange 123. Upper casing 120 and lower casing 122 are coupled to each other by means of a plurality of screws 102 piercing through screw holes 101 and 103. Upper casing 120 and lower casing 122 are mated to each other sufficiently tight enough to prevent leakage of water and to endure the heating water pressure.

A heating water return pipe 126 and an overflow pipe 124 are installed at the lower portion of lower casing 122. Heating water return pipe 126 is a flow path of the heating water that returns from a heating place to lower casing 122. Overflow pipe 124 penetrates through the bottom of lower casing 122 to extend into upper casing 120. Overflow pipe 124 is installed for externally draining an expansion pressure of the heating water resulting from the heating. The upper end of overflow pipe 124 extends just below bypass pipe 190 such that the upper end is higher than the highest water level of the heating water within water tank 114.

Three-way valve 140 is mounted to the right of lower casing 122. Second heating water supply pipe 152 is connected to the upper portion of three-way valve 140. Second heating water supply pipe 152 extends from the left upper side of heating water tank 151 shown in FIG. 9 to be connected to the upper portion of three-way valve 140. A heating water discharge pipe 144 is connected to the lower portion of three-way valve 140. Also, three-way valve 140 is equipped with a three-way valve frame 142 for mounting three-way valve 140 to lower casing 122 and circulation pump 130.

Circulation pump 130 is driven by an electric motor (not shown) to raise a pressure of the heating water and circulate the heating water. First heating water supply pipe 128 connects circulation pump 130 and heat exchanger 150. A pump drain pipe 134 is connected to the lower portion of circulation pump 130. A drain cock 135 is installed to pump drain pipe 134. Also, circulation pump 130 is provided with a circulation pump frame 132 for mounting circulation pump 130 to three-way valve 140.

Water supply pipe 156 is perpendicularly arranged to the right of circulation pump 130 for supplying fresh water into gas boiler 100. Water supply pipe 156 extends from a water source outside gas boiler 100 to be admitted into heating water tank 151 (refer to FIG. 9) of heat exchanger 150 after passing through the right of circulation pump 130. Water valve 155 is installed to the middle of water supply pipe 156. Water valve 155 adjusts the quantity of the fresh water introduced to heat exchanger 150 via water supply pipe 156. Water supply pipe 156, running heating water tank 151 of heat exchanger 150, is arranged as a coil to extend to the upper right portion of heat exchanger 150. Water supply pipe 156 is connected to a hot water supply pipe 159 at the upper right portion of heat exchanger 150. Hot water supply pipe 159 externally extends downward under feed fan 160 mounted below heat exchanger 150.

On the other hand, supplementary water supply pipe 158 is installed between upper casing 120 and water supply pipe 156. Supplementary water supply pipe 158 enables the supplying of the fresh water which is the supplementary water into water tank 114. Supplementary water valve 157 is installed in the middle of supplementary water supply pipe 158. Supplementary water valve 157 adjusts the quantity of the fresh water supplied into water tank 114 via supplementary water supply pipe 158.

Hereinafter, the construction of lower casing 122, three-way valve 140 and circulation pump 130 will be described in detail with reference to FIGS. 2 to 9.

Figure 2:
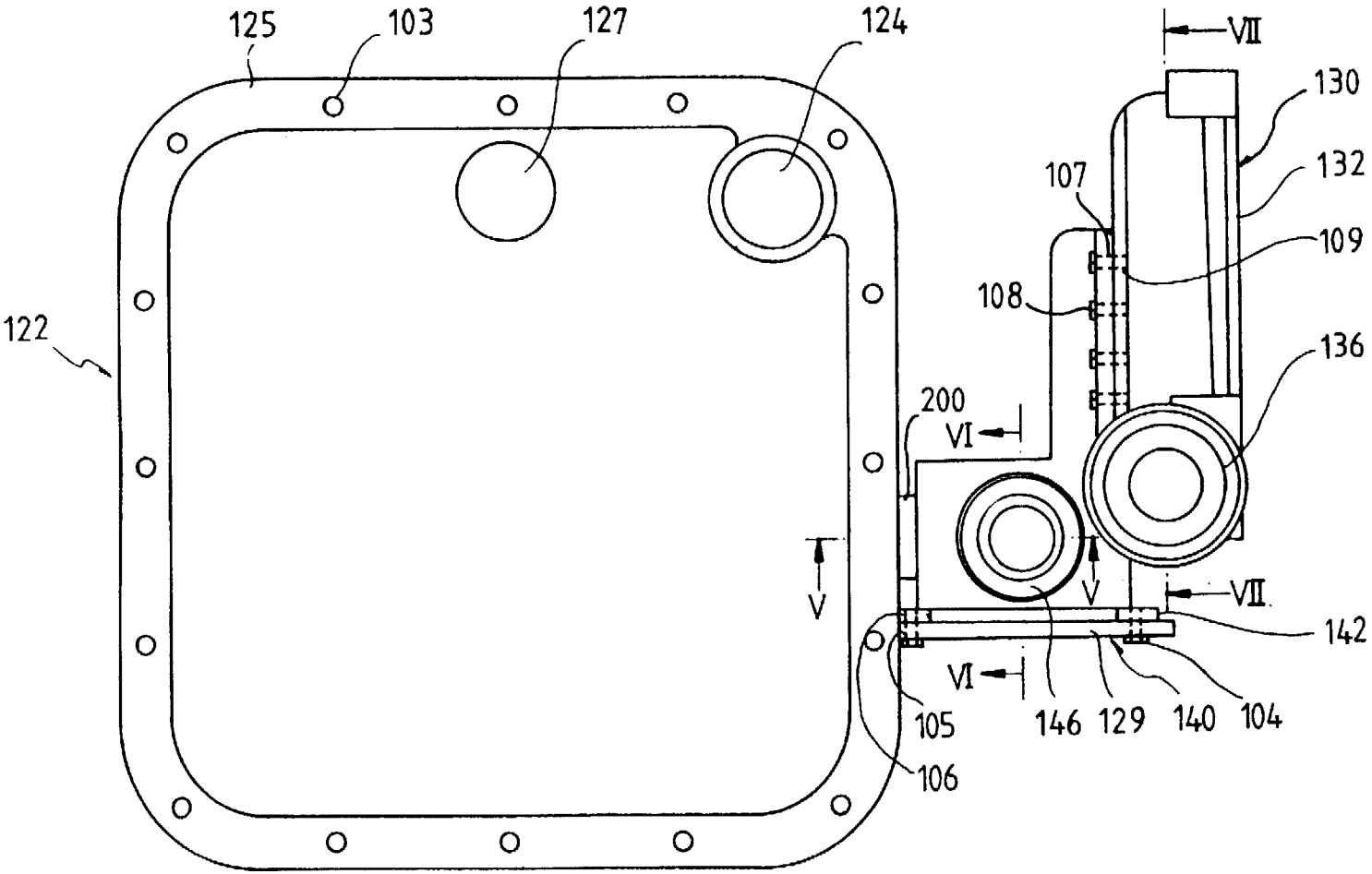
FIG. 2 is a view partially showing the structure of the gas boiler shown in FIG. 1, which is a plan view showing the lower casing, three-way valve and circulation pump.

First, in FIG. 2, lower casing 122 has second flange 125 formed along the upper marginal periphery of lower casing 122. Second flange 125 contains a plurality of screw holes 103 corresponding to plurality of screw holes 101 formed in first flange 123 (refer to FIG. 1). Lower casing 122 has a third flange 129 horizontally extending from the right marginal periphery of second flange 125 to be coupled with three-way valve 140 which places in the right of lower casing 122. Third flange 129 contains a plurality of screw holes 105 for coupling lower casing 122 and three-way valve 140. A heating water return inlet 127 is provided in the lower portion of lower casing 122, to which heating water return pipe 126 (refer to FIG. 1) is connected. Meantime, overflow pipe 124 penetrates through the bottom of lower casing 122 to extend into upper casing 120.

Figure 5:
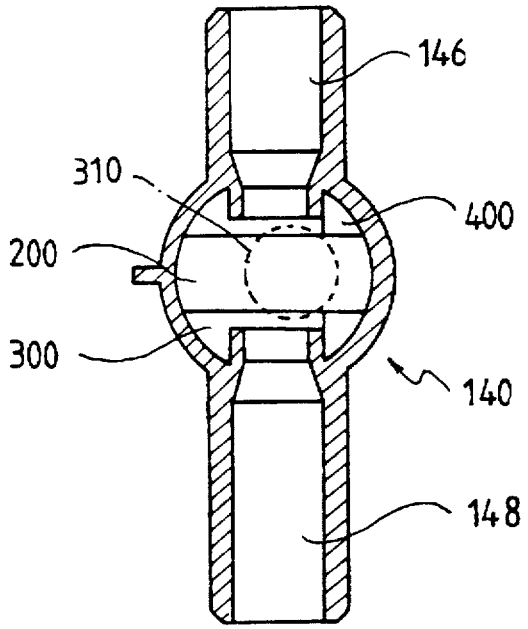
FIG. 5 is a view showing the gas boiler taken along line V—V of FIG. 2, which is a vertical section view of the three-way valve showing the position of the ball of the three-way valve when the operational mode of the gas boiler is a heating mode.
Figure 6:
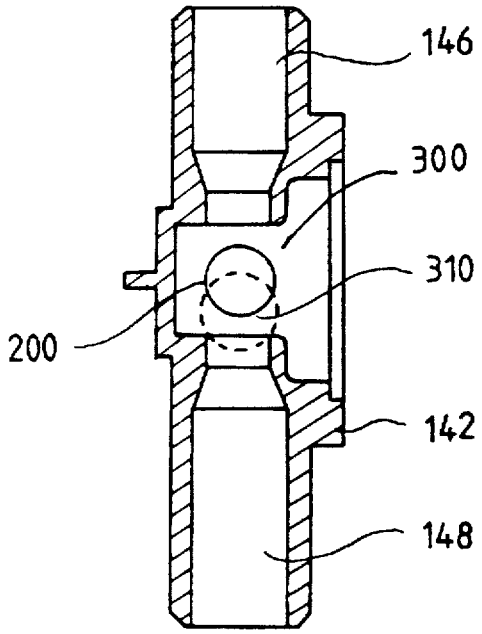
FIG. 6 is a view showing the gas boiler taken along line VI—VI of FIG. 2, which is a vertical section view of the three-way valve showing the position of the ball of the three-way valve when the operational mode of the gas boiler is a hot water mode.

Three-way valve 140 is mounted to the right of lower casing 122, which is substantially identical to three-way valve 40 adopted to conventional gas boiler 10. Three-way valve 140 is equipped with three-way valve frame 142 for mounting three-way valve 140 to lower casing 122. A plurality of screw holes 106 corresponding to plurality of screw holes 105 in third flange 129 of lower casing 122 are formed in the lower portion of three-way valve frame 142 to allow three-way valve 140 to couple with lower casing 122. Lower casing 122 and three-way valve 140 are coupled by means of plurality of screws 104 penetrating through plurality of screw holes 105 and 106. A plurality of screw holes 107 are formed in the right marginal periphery of three-way valve frame 142 to allow three-way valve 140 to couple with circulation pump 130. As illustrated in FIGS. 5 and 6, a heating water supply hole 146 is provided in the upper portion of three-way valve 140, which is connected to second heating water supply pipe 152. A heating water discharge hole 148 is formed in the lower portion of three-way valve 140 to be connected with heating water discharge pipe 144.

Figure 3:
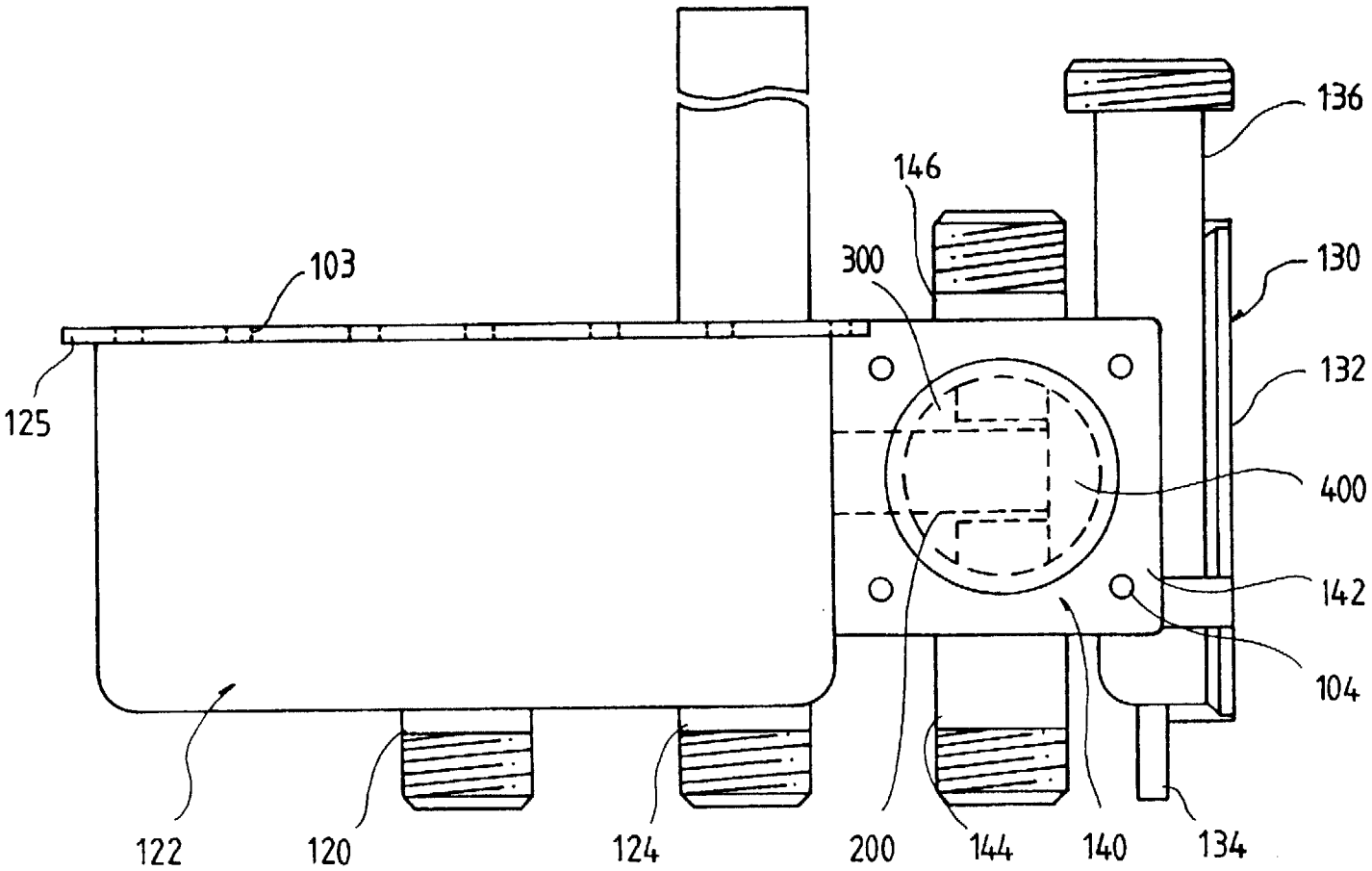
FIG. 3 is a front view showing the lower casing, three-way valve and circulation pump shown in FIG. 2.
Figure 4:
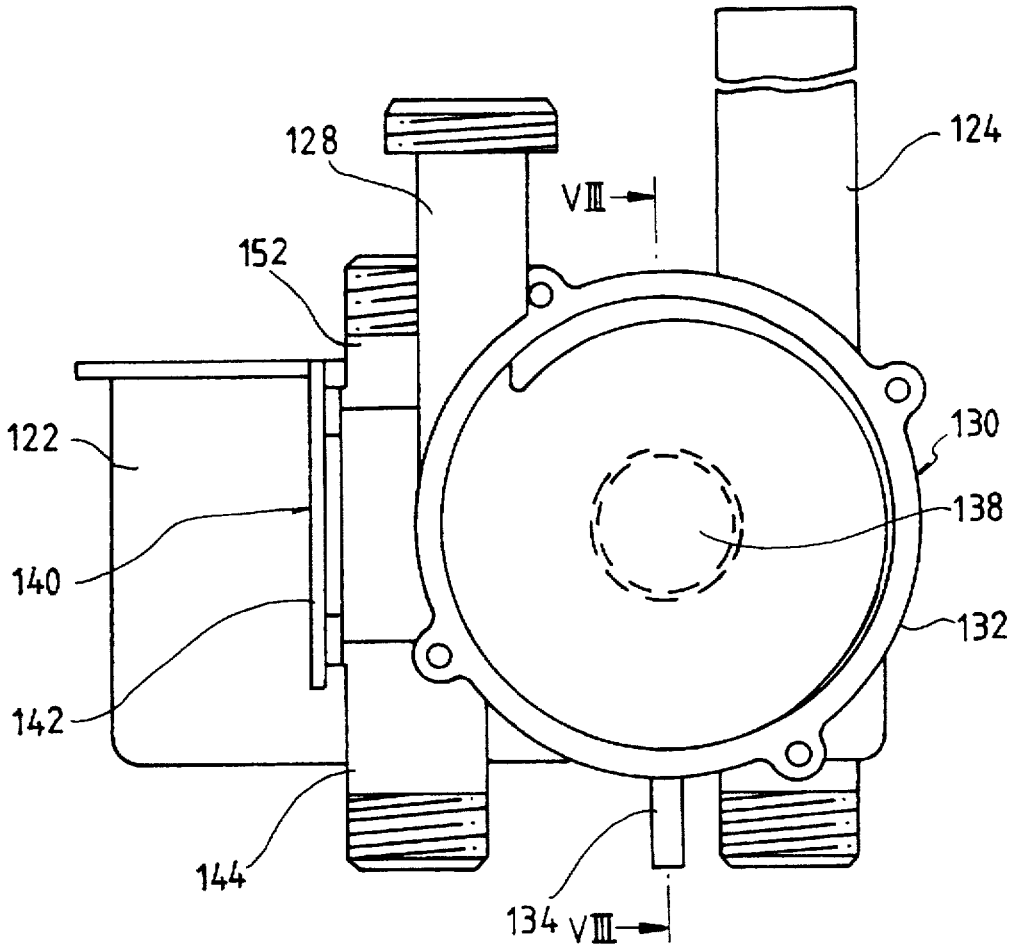
FIG. 4 is a right side view of the lower casing, three-way valve and circulation pump shown in FIG. 2.

As indicated by a dotted-line shown in FIG. 3, a ball space 300 is provided in the center of three-way valve 140, in which a spherical ball 310 is placed for selectively shutting off heating water supply hole 146 and heating water discharge hole 148, as required. Lower casing 122 and three-way valve 140 are connected by a first communicating pipe 200 which extends from lower casing 122 and passes through ball space 300 within three-way valve 140 prior to being connected to the center of a second communicating pipe 400 of circulation pump 130 on the right of three-way valve 140.

Figure 7:
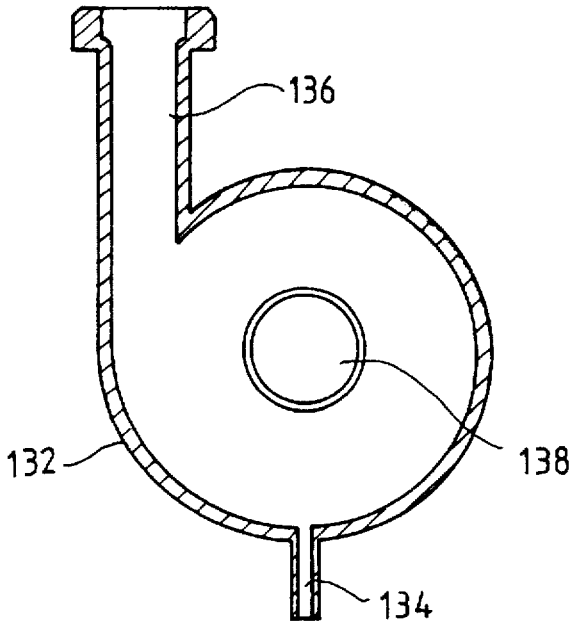
FIG. 7 is a vertical section view taken along line VII—VII of FIG. 2 for showing the circulation pump.
Figure 8:
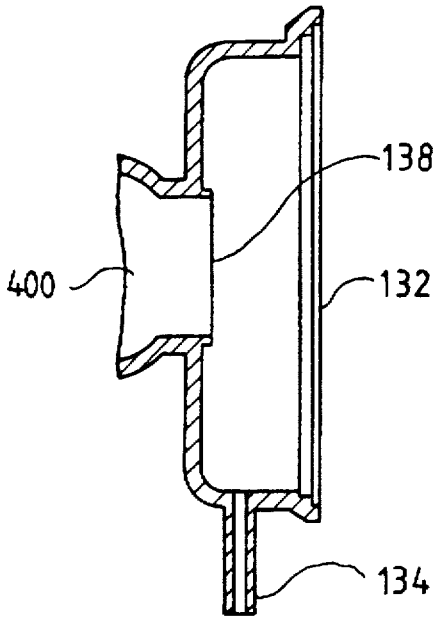
FIG. 8 is a vertical section showing the circulation pump taken along line VIII—VIII of FIG. 4.

As illustrated in FIGS. 2, 7 and 8, circulation pump 130 is formed with second 10 communicating pipe 400 communicated with three-way valve 140 and a heating water inlet hole 136 connected to first heating water supply pipe 128. A pump entrance 138 for admitting the heating water is formed in the center of circulation pump 130. Circulation pump 130 includes a circular circulation pump frame 132 for mounting circulation pump 130 to three-way valve 140. A plurality of screw holes 109 are formed in the left marginal periphery of circulation pump frame 132 for coupling circulation pump 130 to three-way valve 140. Plurality of screw holes 109 correspond to plurality of screw holes 107 formed in the right marginal periphery of three-way valve frame 142. Three-way valve frame 142 and circulation pump frame 132 are coupled with plurality of screws 108 penetrating through plurality of holes 107 and 109. Pump drain pipe 134 is connected to the lower portion of circulation pump frame 132, and drain cock 135 is installed to pump drain pipe 134. Drain cock 135 adjusts the quantity of the heating water discharged from circulation pump 130 to a ditch via pump drain pipe 134 for substituting the heating water.

In the above description, three-way valve 140 is substantially identical to three-way valve 40 which has been adopted in conventional gas boiler 10. Three-way valve 140 is operated by a control signal from a printed circuit board within PCB box 170 of gas boiler 100.

An operation of gas boiler 100 according to the preferred embodiment of the present invention constructed as above will be described in connection with the flow of fluid.

To begin with, the heating water returning to gas boiler 100 since the temperature thereof is lowered after executing room heating is admitted into water tank 114 via heating water return pipe 126. The heating water admitted into water tank 114 blends with the supplementary water which is the fresh water introduced into water tank 114 via supplementary water supply pipe 158 connected to water supply pipe 156 to be supplied to second communicating pipe 400 via first communicating pipe 200.

The heating water entering in second communicating pipe 400 drifts within circulating pump 130 via pump entrance 138 of circulation pump 130. Within circulation pump 130, the heating water is pressed by the pumping operation of circulation pump 130 to be supplied into heating water tank 151 of heat exchanger 150 via first heating water supply pipe 128. The heating water flowing into heating water tank 151 is heated by gas burner 153 in combustion chamber 154 of heat exchanger 150. That is, gas burner 153 ignites the LNG or LPG supplied via gas supply pipe 172 to heat the heating water. The heating water having the temperature raised by the heating is admitted to three-way valve 140 via second heating water supply pipe 152 extending from the left upper portion of heating water tank 151.

Three-way valve 140 opens heating water discharge hole 148 to discharge the heating water when an operational mode of gas boiler 100 is the heating mode. In more detail with reference to FIG. 5, spherical ball 310 placed in ball space 300 of three-way valve 140 shuts off second communicating pipe 400 in accordance with the control signal from the printed circuit board. By doing so, the heating water admitted into three-way valve 140 from second heating water supply pipe 152 is discharged via heating water discharge pipe 144 after passing through ball space 300 of three-way valve 140. The heating water discharged as above is transferred to the heating place 500 via the heating water pipeline. The heating water releasing the heat in the heating place 500 returns into water tank 114 via heating water return pipe 126. The heating water introduced into water tank 114 is successively subjected to the above-described circulation procedure.

On the other hand, different from the circulation of the heating water, the fresh water is supplied into heating water tank 151 of heat exchanger 150 via water supply pipe 156. The fresh water flows via water supply pipe 156 arranged as the coil within heating water tank 151. At this time, the fresh water is changed into the hot water of high temperature by indirectly receiving the heat from the heating water heated by gas burner 153. The hot water prepared as above is guided to the user via hot water supply pipe 159 extending from water supply pipe 156 on the right of heat exchanger 150. Therefore, the heating water and hot water are simultaneously supplied when gas boiler 100 is in the heating mode state.

Separate from the above operation, when the operational mode of gas boiler 100 is in the hot water mode, three-way valve 140 shuts off heating water discharge pipe 148 as shown in FIG. 6 to drift the heating water only within gas boiler 100. More specifically, ball 310 of three-way valve 140 shutting off second communicating pipe 400 is moved in accordance with the control signal from the printed circuit board to shut off the upper end of heating water discharge hole 148. Thus, the heating water having the raised temperature flows into circulation pump 130 via second communicating pipe 400 and pump entrance 138 of circulation pump 130. The heating water having the raised temperature introduced into circulation pump 130 is then provided into heating water tank 151 of heat exchanger 150 via first heating water supply pipe 128 by the pumping operation of circulation pump 130 together with the heating water returning from the heating place. The heating water admitted into heating water tank 151 is heated by gas burner 153 arranged within combustion chamber 154 as mentioned above. The heating water heated in this manner is introduced into three-way valve 140 via second heating water supply pipe 152. Thereafter, the heating water is subjected to the aforestated circulation procedure to drift just within gas boiler 100.

Meanwhile, the hot water is supplied apart from the circulation of the heating water. That is, as described above, the fresh water introduced into heating water tank 151 of heat changer 150 via water supply pipe 156 passes through water supply pipe 156 arranged as the coil within heating water tank 151. At this time, the fresh water is changed into the hot water of high temperature by indirectly receiving the heat from the heating water heated by gas burner 153. The hot water prepared as above is guided to the user via hot water supply pipe 159 extending from the right of heat exchanger 150. Therefore, the hot water is solely supplied independent of the heating operation when gas boiler 100 is in the hot water mode.

In the gas boiler according to the preferred embodiment of the present invention constructed as above, lower casing 122 of water tank 114, three-way valve 140 and circulation pump 130 are successively arranged in a row, and recess 121 is formed in one side of upper casing 120 to accommodate PCB box 170 therein. Then, the internal pipeline work of gas boiler 100 is executed, so that first heating water inlet pipe 28 for connecting water tank 20 and circulation pump 30 in conventional gas boiler 10 is removed, and internal circulation pipe 42 for connecting first heating water inlet pipe 28 and three-way valve 40 is subsequently removed. Thus, wasteful space within gas boiler 10 can be reduced. In addition, the length of other pipelines for connecting respective components is relatively shortened. By doing so, the gas boiler's size can be minimized and the manufacturing cost of the gas boiler is reduced.

While the present invention has been particularly shown and described with reference to a particular embodiment thereof, it will be understood by those skilled in the art that various changes in form and detail may be effected therein without departing from the spirit and scope of the invention, which is defined by the appended claims.

What is claimed is:

1. A gas boiler comprising:

a water tank;

a heat exchanger including a gas burner for heating a first water and a second water, the first water being supplied from a first water supply source outside of said gas boiler to said heat exchanger, and the second water being supplied from said water tank;

a three-way valve connected to said heat exchanger a circulation pump mounted to one side of said three-way valve in opposition to a mounting position of said water tank and in opposition to said three-way valve, said circulation pump providing the heated first and second water with pressure so as to flow;

first guide means for guiding the first water to said heat exchanger and for supplying the first water heated within said heat exchanger to a user, when an operational mode of said gas boiler is a heating mode;

second guide means for guiding the heated second water, said second guide means being communicated with said three-way valve and said heat exchanger, when the operational mode of said gas boiler is a hot water mode so as to supply the heated second water to the user, and for guiding the heated second water to a heating place when the operational mode of said gas boiler is the heating mode;

said three-way valve directing the heating second water to the user through the circulation pump and the second guide means when said gas boiler is in the hot water and for directing the heated second water to the heating place through the circulation pump and the second guide means when said gas boiler is in the heating mode, third guide means for guiding the second water which returns from the heating place into said water tank;

fourth guide means for guiding the second water which has been guided into said water tank, into said circulation pump; and a printed circuit board box having a printed circuit board therein for controlling the operation of said gas boiler.

2. A gas boiler as claimed in claim 1, wherein said first guide means comprises a water supply pipe for supplying the first water from the first water supply source outside of said gas boiler to said heat exchanger, and a hot water supply pipe for supplying the first water heated within said heat exchanger.

3. A gas boiler as claimed in claim 2, wherein said water supply pipe comprises a water valve for controlling the quantity of the first water supplied into said heat exchanger.

4. A gas boiler as claimed in claim 1, wherein said second guide means comprises a second communicating pipe, a first heating water supply pipe, a second heating water supply pipe and a heating water discharge pipe, whereby said three-way valve shuts off said heating water discharge pipe to discharge the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode.

5. A gas boiler as claimed in claim 4, wherein said second communicating pipe allows for fluid communication of said three-way valve and said circulation pump, said first heating water supply pipe allows for the fluid communication of said circulation pump and said heat exchanger, and said second heating water supply pipe allows for the fluid communication of said heat exchanger and said three-way valve.

6. A gas boiler as claimed in claim 1, wherein said three-way valve comprises a three-way valve frame formed with a plurality of coupling holes for mating said three-way valve to said water tank and said circulation pump, a heating water supply hole, a ball space, a spherical ball placed within said ball space and a heating water discharge hole connected to said heating water discharge pipe.

7. A gas boiler as claimed in claim 6, wherein said ball shuts off said heating water discharge hole to discharge the heated second water into said circulation pump via said second communicating pipe in accordance with a control signal from the printed circuit board when the operational mode of said gas boiler is the hot water mode, and shuts off said second communicating pipe to discharge the heated second water via said heating water discharge hole in accordance with the control signal from the printed circuit board when the operational mode of said gas boiler is the heating mode.

8. A gas boiler as claimed in claim 1, wherein said water tank has a rectangularly-shaped section, and comprises an upper casing having a lower portion opened and a lower casing having an upper portion opened.

9. A gas boiler as claimed in claim 8, wherein said upper casing comprises a recess for accommodating said printed circuit board box therein.

10. A gas boiler as claimed in claim 8, wherein said recess is formed in one side of said upper casing.

11. A gas boiler as claimed in claim 8, wherein said upper casing comprises a first flange formed along a lower marginal periphery of said upper casing for coupling said upper casing to said lower casing, and said lower casing comprises a second flange formed along an upper marginal periphery of said lower casing for coupling said upper casing to said lower casing and a third flange horizontally extending from said second flange for coupling said lower casing to said three-way valve, whereby said first flange and said second flange are coupled altogether, and said third flange is coupled to said three-way valve.

12. A gas boiler as claimed in claim 1, wherein said heat exchanger comprises a heating water tank for retaining the second water and a combustion chamber, and the gas burner heats the second water retained within said heating water tank.

13. A gas boiler as claimed in claim 1, wherein said circulation pump comprises a circulation pump frame formed with a plurality of connecting holes for coupling said circulation pump to said three-way valve, a heating water inlet hole, a pump entrance and a pump drain pipe.

14. A gas boiler as claimed in claim 1, wherein said third guide means is a heating water return pipe.

15. A gas boiler as claimed in claim 1, wherein said fourth guide means is a first communicating pipe.

16. A gas boiler as claimed in claim 15, wherein said first communicating pipe extends from one side of said water tank into said circulation pump by passing through said three-way valve.

17. A gas boiler comprising:

a water tank having a rectangularly-shaped section, and including an upper casing having an opened lower portion and a lower casing having an opened upper portion, said upper casing including a recess formed in one side of said upper casing, and a first flange formed along a lower marginal periphery of said upper casing for coupling said upper casing to said lower casing, and said lower casing including a second flange formed along an upper marginal periphery of said lower casing for coupling said upper casing to said lower casing, and a third flange horizontally extending from said second flange, whereby said first flange and said second flange are coupled together, and said third flange is coupled to said three-way valve;

a heat exchanger for heating a first water and a second water, said exchanger including a heating water tank for retaining the second water, a combustion chamber and a gas burner for heating the second water retained within said heating water tank, the first water being supplied from a first water supply source outside of said gas boiler to said exchanger and the second water being supplied from said water tank;

a three-way valve connected to said heat exchanger;

a circulation pump mounted to one side of said three-way valve in opposition to the mounting position of said water tank and in opposition to said three-way valve, said circulation pump including a circulation pump frame having a plurality of connecting holes for coupling said circulating pump to said three-way valve, a heating water inlet hole, a pump entrance and a pump drain pipe, said circulation pump providing the heated first and second water with pressure so as to flow;

first guide means for guiding the first water to said heat exchanger and supplying the first water heated within said heat exchanger to a user when an operational mode of said gas boiler is a heating mode, said first guide means including a water supply pipe for supplying the first water from a first water supply source outside of said gas boiler to said heat exchanger, and a hot water supply pipe for supplying the first water heated within said heat exchanger, said water supply pipe having a water valve for controlling the quality of the first water supplied into said heat exchanger;

second guide means for guiding the heated second water, said second guide means being communicate with said three-way valve and said heat exchanger when the operational mode of said gas boiler is the hot water mode, so as to supply the heated second water to the user, and for directing the heated second water to a heating place by the operation of said three-way valve when the operational mode of said gas boiler is a heating mode, said second guide means including a second communicating pipe, a first heating water supply pipe, a second heating water supply pipe and a heating water discharge pipe, whereby said three-way valve shuts off said heating water discharge pipe to discharge the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode;

said three-way valve directing the heated second water to the user through the circulation pump and the second guide means when said gas boiler is in the hot water mode and for directing the heated second water to the heating place through the circulation pump and the second guide means when said gas boiler is in the heating mode, said three-way valve mounted to one side of said water tank, said three-way valve including a three-way valve frame having a plurality of coupling holes for connecting said three-way valve with said water tank and said circulation pump, a heating water supply hole, a ball space, a spherical ball placed within said ball space and a heating water discharge hole connected to said heating water discharge pipe;

a heating water return pipe for guiding the second water returning from the heating place into said water tank;

a first communicating pipe for guiding the second water which has been guided into said water tank into said circulation pump, said first communicating pipe extending from one side of said water tank into said circulation pump by passing through said three-way valve; and a printed circuit board box having a printed circuit board therein for controlling the operation of said gas boiler.

18. A gas boiler as claimed in claim 17, wherein said second communicating pipe allows for fluid communication of said three-way valve and said circulation pump, said first heating water supply pipe allows for the fluid communication of said circulation pump and said heat exchanger, and said second heating water supply pipe allows for the fluid communication of said heat exchanger and said three-way valve.

19. A gas boiler as claimed in claim 17, wherein said ball shuts off said heating water discharge hole to discharge the heated second water into said circulation pump via said second communicating pipe in accordance with a control signal from the printed circuit board when the operational mode of said gas boiler is the hot water mode, and shuts off said second communicating pipe to discharge the heated second water via said heating water discharge hole in accordance with the control signal from the printed circuit board when the operational mode of said gas boiler is the heating mode.

20. A gas boiler comprising:

a water tank having a rectangularly-shaped section, and including an upper casing having an opened lower portion and a lower casing having an opened upper portion, said upper casing including a recess formed in one side of said upper casing, a first flange formed along a lower marginal periphery of said upper casing for coupling said upper casing to said lower casing, and said lower casing including a second flange formed along an upper marginal periphery of said lower casing for coupling said upper casing to said lower casing and a third flange optionally extending from said second flange, whereby said first flange and said second flange are coupled altogether, and said third flange is coupled to said three-way valve;

a heat exchanger for heating a first water and a second water, said heat exchanger including a heating water tank for retaining the second water, a combustion chamber and a gas burner for heating the second water retaining within said heating water tank, the first water being supplied from a first water supply source outside of said gas boiler to said exchanger and the second water being supplied from said water tank;

a three-way valve connected to said heat exchanger;

a circulation pump mounted to one side of said three-way valve in opposition to the mounting position of said water tank and in opposition to said three-way valve, said circulation pump including a circulation pump frame having a plurality of connecting holes for coupling said circulation pump to said three-way valve, a heating water inlet hole, a pump entrance and a pump drain pipe, said circulation pump providing the heated first and second water with pressure so as to flow;

first guide means for guiding the first water to said heat exchanger and supplying the first water heated within said heat exchanger to a user, said first guide means including a water supply pipe for supplying the first water from a first water supply source outside of said gas boiler to said heat exchanger, and a hot water supply pipe for supplying the first water heated within said heat exchanger, said water supply pipe having a water valve for controlling the quantity of the first water supplied into said heat exchanger, when an operational mode of said gas boiler is a heating mode;

second guide means for guiding the heated second water, said second guide means being communicated with said three-way valve and said heat exchanger when the operational mode of said gas boiler is a hot water mode so as to supply the heated second water to the user, and for guiding the heated second water to a heating place when the operational mode of said gas boiler is the heating mode, said second guide means including a second communicating pipe, a first heating water supply pipe, a second heating water supply pipe and a heating water discharge pipe, said second communicating pipe fluid-communicating said three-way valve with said circulation pump, said first heating water supply pipe fluid-communicating with said heat exchanger, and said second heating water supply pipe fluid-communicating said heat exchanger with said three-way valve, whereby said three-way valve shut off said heating water discharge pipe to discharge the heated second water into said circulation pump via said second communicating pipe when the operational mode of said gas boiler is the hot water mode, and shuts off said second communicating pipe to discharge the heated second water to the heating place via said heating water discharge pipe when the operational mode of said gas boiler is the heating mode;

said three-way valve directing the heated second water to the user through the circulation pump and the second guide means when said gas boiler is in the hot water mode and for directing the heated second water to the heating place through the circulation pump and the second guide means when said gas boiler is in the heating mode, said three-way valve mounted to one side of said water tank, said three-way valve including a three-way valve frame having a plurality of coupling holes for connecting said three-way valve with said water tank and said circulation pump, a heating water supply hole, a ball space, a spherical ball spaced within said ball space and a heating water discharge hole connected to said heating water discharge pipe a heating water return pipe for guiding the second water which returns from the heating place into said water tank;

a first communicating pipe for guiding the second water directed into said water tank into said circulation pump, said first communicating pipe extends from one side of said water tank into said circulation pump by passing through said three-way valve; and a printed circuit board box having a printed circuit board therein for controlling the operation of said gas boiler, wherein said ball shuts off said heating water discharge hole to discharge the heated second water into said circulation pump via said second communicating pipe in accordance with a control signal from the printed circuit board when the operational mode of said gas boiler is the hot water mode, and shuts off said second communicating pipe to discharge the heated second water via said heating water discharge hole in accordance with the control signal from the printed circuit board.

* * * * *